US011202467B2

(12) United States Patent
Malgat

(10) Patent No.: US 11,202,467 B2
(45) Date of Patent: Dec. 21, 2021

(54) AEROSOL-GENERATING ARTICLE COMPRISING AN AEROSOL-FORMING SUBSTRATE AND A HEAT-CONDUCTING ELEMENT

(71) Applicant: Philip Morris Products S.A., Neuchatel (CH)

(72) Inventor: Alexandre Malgat, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 309 days.

(21) Appl. No.: 16/320,168

(22) PCT Filed: Aug. 23, 2017

(86) PCT No.: PCT/EP2017/071240
§ 371 (c)(1),
(2) Date: Jan. 24, 2019

(87) PCT Pub. No.: WO2018/037048
PCT Pub. Date: Mar. 1, 2018

(65) Prior Publication Data

US 2019/0269169 A1 Sep. 5, 2019

(30) Foreign Application Priority Data

Aug. 26, 2016 (EP) ..... 16185881

(51) Int. Cl.
*A24B 15/16* (2020.01)
*A24D 1/02* (2006.01)
(Continued)

(52) U.S. Cl.
CPC ..... *A24D 1/02* (2013.01); *A24B 15/165* (2013.01); *A24D 1/20* (2020.01); *A24D 1/22* (2020.01); *A24F 40/20* (2020.01); *A24F 40/465* (2020.01)

(58) Field of Classification Search
None
See application file for complete search history.

(56) References Cited

U.S. PATENT DOCUMENTS 4,732,168 A 3/1988 Resce et al.
5,040,551 A 8/1991 Schlatter et al.
(Continued)

FOREIGN PATENT DOCUMENTS

CN 103889254 A 6/2014
CN 103929989 A 7/2014
(Continued)

OTHER PUBLICATIONS

International Search Report dated Feb. 6, 2018, in PCT/EP2017/071240, filed Aug. 23, 2017.
(Continued)

*Primary Examiner* — Dennis R Cordray
(74) *Attorney, Agent, or Firm* — Oblon, McClelland, Maier & Neustadt, L.L.P.

(57) ABSTRACT

An aerosol-generating article is provided, including an aerosol-forming substrate including aerosol-forming material and a tobacco-containing wrapper around and in contact with the aerosol-forming material, the wrapper having an aerosol former content of between about 5% and about 30% by weight of the total weight of the wrapper; a combustible heat source upstream of the aerosol-forming substrate; and a heat-conducting element around and in contact with at least a portion of the wrapper.

14 Claims, 2 Drawing Sheets

Figure 1:
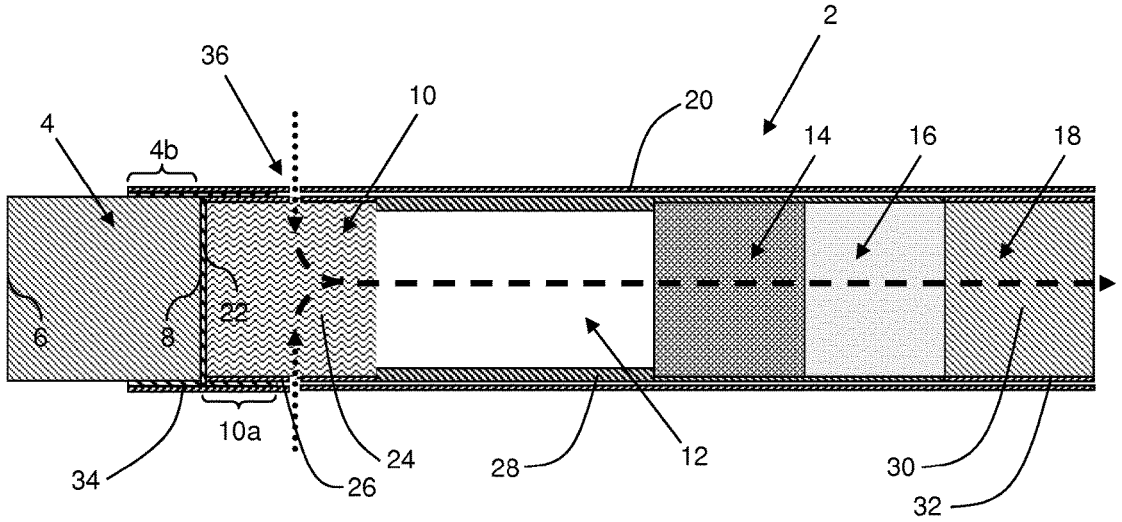

(51) Int. Cl.

| | |
|---|---|
| ***A24D 1/20*** | (2020.01) |
| ***A24D 1/22*** | (2020.01) |
| *A24F 40/20* | (2020.01) |
| *A24F 40/465* | (2020.01) |

(56) References Cited

U.S. PATENT DOCUMENTS

| | | | | |
|---|---|---|---|---|
| 7,726,320 | B2 | 6/2010 | Robinson et al. | |
| 2007/0023056 | A1* | 2/2007 | Cantrell | A24F 47/004 131/194 |
| 2007/0157940 | A1 | 7/2007 | Mua et al. | |
| 2007/0215168 | A1 | 9/2007 | Banerjee et al. | |
| 2009/0065011 | A1 | 3/2009 | Maeder et al. | |
| 2011/0271971 | A1 | 11/2011 | Conner et al. | |
| 2014/0283860 | A1* | 9/2014 | Stolz | A24F 47/006 131/330 |
| 2015/0040924 | A1* | 2/2015 | Mironov | A24D 1/22 131/328 |
| 2016/0073687 | A1 | 3/2016 | Banerjee et al. | |
| 2016/0150825 | A1 | 6/2016 | Mironov et al. | |
| 2017/0318859 | A1 | 11/2017 | Batista | |

FOREIGN PATENT DOCUMENTS

| | | | |
|---|---|---|---|
| CN | 105407750 | A | 3/2016 |
| EA | 201070253 | A1 | 6/2010 |
| JP | H8-511175 | A | 11/1996 |
| JP | H9-28366 | A | 2/1997 |
| JP | 2009-502194 | A | 1/2009 |
| JP | 2010-535530 | A | 11/2010 |
| PH | 1-2014-502502 | A1 | 12/2014 |
| RU | 2 248 738 | C2 | 8/2003 |
| WO | WO 2009/022232 | A2 | 2/2009 |
| WO | WO 2009/074870 | A2 | 6/2009 |
| WO | WO 2012/164009 | A2 | 12/2012 |
| WO | WO 2012/164077 | A1 | 12/2012 |
| WO | WO 2013/178769 | A1 | 12/2013 |
| WO | WO 2015/082652 | A1 * | 6/2015 |
| WO | WO 2015/177294 | A1 | 11/2015 |
| WO | WO 2016/079342 | A1 | 5/2016 |

OTHER PUBLICATIONS

Written Opinion dated Feb. 6, 2018, in PCT/EP2017/071240, filed Aug. 23, 2017.

"From Wood to Paper: A Diagram of the Process & Chemistry", Idaho Forest Products Commission, Retrieved from: http://www.idahoforests.org/forest_to_paper.htm, Mar. 26, 2019, 1 page.

"Size Press", Papcel, Retrieved from: http://www.paper-machine-papcel.com/products/paper-machines/machines/size-press/, Mar. 26, 2019, 4 pages.

"Paper: Papermaking process", Britannica Kids, Retrieved from: http://kids.britannica.com/comptons/art-53771/The-papermaking-process-begins-with-sending-logs-through-a-barker, Mar. 30, 2019, 1 page.

Russian Office Action dated Nov. 16, 2020 in Russian Patent Application No. 2019102197 (with English translation), 10 pages.

Russian Search Report dated Nov. 16, 2020 in Russian Patent Application No. 2019102197 (with English translation), 4 pages.

Combined Chinese Office Action and Search Report dated Apr. 2, 2021 in Chinese Patent Application No. 201780046965.6 (with English translation), 23 pages.

Japanese Decision to Grant dated Aug. 30, 2021 in corresponding Japanese Patent Application No. 2019-510326 (with English translation), 4 pages.

* cited by examiner

AEROSOL-GENERATING ARTICLE COMPRISING AN AEROSOL-FORMING SUBSTRATE AND A HEAT-CONDUCTING ELEMENT

The present invention relates to an aerosol-generating article comprising an aerosol-forming substrate and a heat-conducting element. In certain examples, the present invention relates to an aerosol-generating article comprising a combustible heat source, an aerosol-forming substrate downstream of the combustible heat source and a heat-conducting element circumscribing at least a rear portion of the combustible heat source and at least a front portion of the aerosol-forming substrate. In other examples, the present invention relates to an aerosol-generating article comprising an aerosol-forming substrate and a heat conducting element, wherein the heat-conducting element is a susceptor capable of being heated by an electrically-operated device comprising an inductor for producing a fluctuating or alternating electromagnetic field.

A number of smoking articles in which tobacco material is heated rather than combusted have been proposed in the art. An aim of such 'heated' smoking articles is to reduce known harmful smoke constituents of the type produced by the combustion and pyrolytic degradation of tobacco in conventional cigarettes.

Typically in heated smoking articles, an aerosol is generated by the transfer of heat from a heat source, for example, a chemical, electrical or combustible heat source, to a physically separate aerosol-forming substrate comprising a tobacco material, which may be located within, around or downstream of the heat source.

In one type of heated smoking article, an aerosol is generated by the transfer of heat from a combustible carbonaceous heat source to a physically separate aerosol-forming substrate comprising tobacco material that is located downstream of the combustible carbonaceous heat source. In use, volatile compounds are released from the tobacco material by heat transfer to the aerosol-forming substrate from the combustible carbonaceous heat source and entrained in air drawn through the smoking article. As the released compounds cool, they condense to form an aerosol that is inhaled by the user.

In such heated smoking articles it is known to include a heat-conducting element around at least a rear portion of the combustible carbonaceous heat source and at least a front portion of the aerosol-forming substrate of the heated smoking article in order to provide conductive heat transfer from the combustible carbonaceous heat source to the aerosol-forming substrate to generate an aerosol. For example, WO-A2-2009/022232 discloses a smoking article comprising a combustible carbonaceous heat source, an aerosol-forming substrate downstream of the combustible heat source, and a heat-conducting element around and in direct contact with a rear portion of the combustible carbonaceous heat source and an adjacent front portion of the aerosol-forming substrate. In use, heat generated during combustion of the combustible carbonaceous heat source is transferred to the periphery of the front portion of the aerosol-forming substrate by conduction through the abutting downstream end of the combustible carbonaceous heat source and the heat-conducting element.

In another type of heated smoking article, an aerosol is generated by the transfer of heat from a susceptor to an aerosol-forming substrate comprising tobacco material. In use, eddy currents are induced in the susceptor by an alternating electromagnetic field produced by an induction source in a physically separate inductive heating device. Heat is generated in the susceptor due to resistive losses (Joule heating). Heat may also be generated in the susceptor due to hysteresis losses where the susceptor is magnetic. Volatile compounds are released from the tobacco material by heat transfer to the aerosol-forming substrate from the susceptor and entrained in air drawn through the smoking article. As the released compounds cool, they condense to form an aerosol that is inhaled by the user.

In heated smoking articles in which tobacco material is heated rather than combusted, the temperature attained in the aerosol-forming substrate has a significant impact on the ability to generate a sensorially acceptable aerosol. In heated smoking articles in which heating of the tobacco material occurs primarily by conductive heat transfer to the periphery of the aerosol-forming substrate, the temperature attained in the aerosol-forming substrate may not be sufficiently high to release enough volatile compounds from the tobacco material to produce an acceptable aerosol during early puffs. This may adversely impact the consistency of aerosol delivery to a user.

According to the invention there is provided an aerosol-generating article comprising: an aerosol-forming substrate comprising aerosol-forming material and a wrapper around and in contact with the aerosol-forming material, the wrapper having an aerosol former content of between about 5% and about 30% by weight of the total weight of the wrapper; and a heat-conducting element around and in contact with at least a portion of the wrapper.

Aerosol-generating articles according to the invention comprise a heat-conducting element around and in contact with at least a portion of the wrapper for transferring heat to the periphery of the aerosol-forming substrate by conduction.

The wrapper may be in indirect contact with the aerosol-forming material.

As used herein, the term 'indirect contact' is used to mean contact between two components via one or more intermediate materials interposed between the two components, such that the surfaces of the two components are not touching each other.

Preferably, the wrapper is in direct contact with the aerosol-forming material.

As used herein, the term 'direct contact' is used to mean contact between two components without any intermediate material, such that the surfaces of the two components are touching each other.

The inclusion of a wrapper having an aerosol former content of between about 5% and about 30% by weight of the total weight of the wrapper around and in contact with the aerosol-forming material of the aerosol-forming substrate of aerosol-generating articles according to the invention advantageously results in a more consistent aerosol delivery from puff to puff than is obtained for aerosol-generating articles comprising an aerosol-forming substrate comprising aerosol-forming material and a wrapper around and in contact with the aerosol-forming material wherein the wrapper does not have an aerosol former content of between about 5% and about 30% by weight of the total weight of the wrapper.

In particular, the inclusion of a wrapper having an aerosol former content of between about 5% and about 30% by weight of the total weight of the wrapper around and in contact with the aerosol-forming material of the aerosol-forming substrate of aerosol-generating articles according to the invention advantageously results in an increase in aerosol delivery in initial and final puffs compared to aerosol-generating articles comprising an aerosol-forming substrate comprising aerosol-forming material and a wrapper around and in contact with the aerosol-forming material wherein the wrapper does not have an aerosol former content of between about 5% and about 30% by weight of the total weight of the wrapper.

By increasing the aerosol delivery in initial puffs, the inclusion of a wrapper having an aerosol former content of between about 5% and about 30% by weight of the total weight of the wrapper around and in contact with the aerosol-forming material of the aerosol-forming substrate of aerosol-generating articles according to the invention advantageously reduces the length of time required after a user commences use of the aerosol-generating article for a sensorially acceptable aerosol to be produced.

The inclusion of a wrapper having an aerosol former content of between about 5% and about 30% by weight of the total weight of the wrapper around and in contact with the aerosol-forming material of the aerosol-forming substrate may also advantageously improve the initial odour of aerosol-generating articles according to the invention compared to aerosol-generating articles comprising an aerosol-forming substrate comprising aerosol-forming material and a wrapper around and in contact with the aerosol-forming material wherein the wrapper does not have an aerosol former content of between about 5% and about 30% by weight of the total weight of the wrapper. In particular, the inclusion of a wrapper having an aerosol former content of between about 5% and about 30% by weight of the total weight of the wrapper around and in contact with the aerosol-forming material of the aerosol-forming substrate of aerosol-generating articles according to the invention may advantageously reduce or eliminate undesirable initial 'burnt' odours or 'off-notes' that may be encountered with aerosol-generating articles comprising an aerosol-forming substrate comprising aerosol-forming material and a wrapper around and in contact with the aerosol-forming material wherein the wrapper does not have an aerosol former content of between about 5% and about 30% by weight of the total weight of the wrapper.

Aerosol-generating articles according to the invention comprise an aerosol-forming substrate comprising aerosol-forming material and a wrapper around and in contact with the aerosol-forming material, the wrapper having an aerosol former content of greater than or equal to about 5% by weight of the total weight of the wrapper.

The wrapper may have an aerosol former content of at least about 8% by weight of the total weight of the wrapper.

Advantageously, the wrapper has an aerosol former content of at least about 10% by weight of the total weight of the wrapper.

The wrapper may have an aerosol former content of at least about 12% by weight of the total weight of the wrapper.

For example, the wrapper may have an aerosol former content of between about 8% and about 30% by weight of the total weight of the wrapper, between about 10% and about 30% by weight of the total weight of the wrapper or between about 12% and about 30% by weight of the total weight of the wrapper.

Aerosol-generating articles according to the invention comprise an aerosol-forming substrate comprising aerosol-forming material and a wrapper around and in contact with the aerosol-forming material, the wrapper having an aerosol former content of less than or equal to about 30% by weight of the total weight of the wrapper.

The wrapper may have an aerosol former content of less than or equal to about 25% by weight of the total weight of the wrapper.

For example, the wrapper may have an aerosol former content of between about 5% and about 25% by weight of the total weight of the wrapper, between about 8% and about 25% by weight of the total weight of the wrapper, between about 10% and about 25% by weight of the total weight of the wrapper or between about 12% and about 25% by weight of the total weight of the wrapper.

Advantageously, the wrapper has an aerosol former content of less than or equal to about 20% by weight of the total weight of the wrapper.

For example, the wrapper may have an aerosol former content of between about 5% and about 20% by weight of the total weight of the wrapper, between about 8% and about 20% by weight of the total weight of the wrapper, between about 10% and about 20% by weight of the total weight of the wrapper or between about 12% and about 20% by weight of the total weight of the wrapper.

The wrapper may have an aerosol former content of less than or equal to about 18% by weight of the total weight of the wrapper.

For example, the wrapper may have an aerosol former content of between about 5% and about 18% by weight of the total weight of the wrapper, between about 8% and about 18% by weight of the total weight of the wrapper, between about 10% and about 18% by weight of the total weight of the wrapper or between about 12% and about 18% by weight of the total weight of the wrapper.

The wrapper may have an aerosol former content of less than or equal to about 16% by weight of the total weight of the wrapper.

For example, the wrapper may have an aerosol former content of between about 5% and about 16% by weight of the total weight of the wrapper, between about 8% and about 16% by weight of the total weight of the wrapper, between about 10% and about 16% by weight of the total weight of the wrapper or between about 12% and about 16% by weight of the total weight of the wrapper.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

The wrapper may be formed from any suitable sheet material that is capable of being wrapped around aerosol-forming material to form an aerosol-forming substrate.

Advantageously, the wrapper is a paper wrapper. As used herein, the term 'paper wrapper' is used to describe a wrapper formed from cellulosic fibres.

Suitable paper wrappers are known in the art and include, but are not limited to, paper wrappers used as cigarette papers and filter plug wraps in conventional cigarettes.

The wrapper may be a non-tobacco-containing wrapper.

For example, the wrapper may be a non-tobacco-containing paper wrapper.

As used herein, the term 'non-tobacco-containing wrapper' is to describe a wrapper that does not comprise tobacco material.

The wrapper may be a tobacco-containing wrapper. This may advantageously further improve the initial odour of aerosol-generating articles according to the invention.

For example, the wrapper may be a tobacco-containing paper wrapper.

As used herein, the term 'tobacco-containing wrapper' is used to describe a wrapper comprising tobacco material.

Suitable tobacco-containing wrappers are known in the art and include, but are not limited to, reconstituted tobacco sheet materials and homogenised tobacco sheet materials.

The heat-conducting element may be in indirect contact with at least a portion of the wrapper.

Advantageously, the heat-conducting element is in direct contact with at least a portion of the wrapper. This may facilitate conductive heat transfer to the aerosol-forming substrate.

Advantageously, the heat-conducting element is non-combustible.

The heat conducting element may be oxygen restricting. In other words, the heat-conducting element may inhibit or resist the passage of oxygen through the heat-conducting element.

The heat-conducting element may be formed from any suitable thermally conductive material or combination of materials.

Suitable thermally conductive materials are known in the art and include, but are not limited to: metal foils, such as, for example, aluminium foil, steel foil, iron foil and copper foil; and metal alloy foils.

Preferably, the heat-conducting element comprises one or more heat-conductive materials having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23° C. and a relative humidity of 50% as measured using the modified transient plane source (MTPS) method.

Advantageously, the heat-conducting elements comprises one or more metals, one or more metal alloys or a combination of one or more metals and one or more metal alloys.

Advantageously, the heat-conducting element comprises aluminium foil.

The heat-conducting element may be formed of a single layer of heat-conductive material. Alternatively, the heat-conducting element may be formed of a multilayer or laminate material comprising at least one layer of heat-conductive material in combination with one or more other heat-conductive layers or non-heat-conductive layers. In such embodiments, the at least one layer of heat-conductive material may comprise any of the heat-conductive materials listed above.

For example, the heat-conducting element may be formed of a laminate material comprising at least one layer of heat-conductive material and at least one layer of heat-insulative material, such as paper.

The heat-conducting element may be a susceptor. As described further below, in such embodiments the aerosol-generating article may be configured for use with an electrically-operated aerosol-generating device comprising an inductor for producing a fluctuating or alternating electromagnetic field.

As used herein, the term 'aerosol-forming substrate' is used to describe a substrate comprising aerosol forming material capable of releasing upon heating volatile compounds, which can form an aerosol. The aerosols generated from aerosol-forming substrates of aerosol generating articles according to the invention may be visible or invisible and may include vapours (for example, fine particles of substances, which are in a gaseous state, that are ordinarily liquid or solid at room temperature) as well as gases and liquid droplets of condensed vapours.

Advantageously, the aerosol-forming material comprises an aerosol-former.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

The aerosol-forming material may comprise the same aerosol former as the wrapper.

Alternatively, the aerosol-forming material may comprise a different aerosol former to the wrapper.

Preferably, the aerosol-forming substrate is a solid aerosol-forming substrate. The aerosol-forming substrate may comprise both solid and liquid components.

The aerosol-forming substrate may comprise plant-based material. The aerosol-forming substrate may comprise homogenised plant-based material.

The aerosol-forming substrate may comprise nicotine.

The aerosol-forming substrate may comprise tobacco material. As used herein, the term 'tobacco material' is used to describe any material comprising tobacco, including, but not limited to, tobacco leaf, tobacco rib, tobacco stem, tobacco stalk, tobacco dust, expanded tobacco, reconstituted tobacco material and homogenised tobacco material.

The tobacco material may, for example, be in the form of powder, granules, pellets, shreds, strands, strips, sheets or any combination thereof.

Advantageously, the tobacco material comprises a homogenised tobacco material.

As used herein, the term 'homogenised tobacco material' is used to describe a material formed by agglomerating particulate tobacco.

Advantageously, the aerosol-forming substrate comprises a gathered sheet of homogenised tobacco material.

In preferred embodiments, the aerosol-forming substrate comprises a rod comprising a gathered sheet of homogenised tobacco material and a wrapper around and in contact with the tobacco material, the wrapper having an aerosol former content of between about 5% and about 30% by weight of the total weight of the wrapper.

As used herein, the term 'rod' is used to denote a generally cylindrical element of substantially circular, oval or elliptical cross-section.

As used herein, the term 'sheet' is used to describe a laminar element having a width and length substantially greater than the thickness thereof.

As used herein, the term 'gathered' is used to describe a sheet that is convoluted, folded, or otherwise compressed or constricted substantially transversely to the longitudinal axis of the aerosol-generating article.

Advantageously, the aerosol-forming substrate comprises a gathered textured sheet of homogenised tobacco material.

As used herein, the term 'textured sheet' is used to describe a sheet that has been crimped, embossed, debossed, perforated or otherwise deformed.

Use of a textured sheet of homogenised tobacco material may advantageously facilitate gathering of the sheet of homogenised tobacco material to form the aerosol-forming substrate.

The aerosol-forming substrate may comprise a gathered textured sheet of homogenised tobacco material comprising a plurality of spaced-apart indentations, protrusions, perforations or any combination thereof.

In preferred embodiments, the aerosol-forming substrate comprises a gathered crimped sheet of homogenised tobacco material.

As used herein, the term 'crimped sheet' is used to describe a sheet having a plurality of substantially parallel ridges or corrugations.

Advantageously, when the aerosol-generating article has been assembled, the substantially parallel ridges or corrugations extend along or parallel to the longitudinal axis of the aerosol-generating article. This facilitates gathering of the crimped sheet of homogenised tobacco material to form the aerosol-forming substrate.

However, it will be appreciated that crimped sheets of homogenised tobacco material for inclusion in the aerosol-forming substrate of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

Preferably, the aerosol-forming substrate is substantially cylindrical.

The aerosol-forming substrate may have a length of between about 5 mm and about 20 mm, for example a length of between about 6 mm and about 15 mm or a length of between about 7 mm and about 12 mm.

The aerosol-forming substrate may have a diameter of between about 5 mm and about 9 mm, for example a diameter of between about 7 mm and about 8 mm.

As used herein, the terms 'distal', 'upstream' and 'front', and 'proximal', 'downstream' and 'rear', are used to describe the relative positions of components, or portions of components, of aerosol-generating articles according to the invention. Aerosol-generating articles according to the invention comprise a proximal end through which, in use, an aerosol exits the aerosol-generating article for delivery to a user. The proximal end of the aerosol-generating article may also be referred to as the mouth end. In use, a user draws on the proximal end of the aerosol-generating article in order to inhale an aerosol generated by the aerosol-generating article.

Aerosol-generating articles according to the invention comprise a distal end. The proximal end of the aerosol-generating article is downstream of the distal end of the aerosol-generating article. The proximal end of the aerosol-generating article may also be referred to as the downstream end of the aerosol-generating article and the distal end of the aerosol-generating article may also be referred to as upstream end of the aerosol-generating article. Components, or portions of components, of aerosol-generating article according to the invention may be described as being upstream or downstream of one another based on their relative positions between the proximal end of the aerosol-generating article and the distal end of the aerosol-generating article.

As used herein, the terms 'longitudinal' and 'axial' are used to describe the direction between the proximal end and the distal end of the aerosol-generating article.

As used herein, the term 'length' is used to describe the maximum dimension of components, or portions of components, of aerosol-generating articles according to the invention in the longitudinal direction of the aerosol-generating article. That is, the maximum dimension in the direction between the proximal end and the distal end of the aerosol-generating article.

As used herein, the term 'transverse' is used to describe the direction perpendicular to the longitudinal direction. That is, the direction perpendicular to the direction between the proximal end and the distal end of the aerosol-generating article.

As used herein, the term 'diameter' denotes the maximum dimension in the transverse direction of the aerosol-generating article.

The heat-conducting element may be around and in contact with the wrapper along substantially the entire length of the wrapper.

Alternatively, the heat-conducting element may be around and in contact with the wrapper along only a portion of the length of the wrapper.

As stated above, in certain embodiments the heat-conducting element may be a susceptor and the aerosol-generating article may be configured for use with an electrically-operated aerosol-generating device comprising an inductor for producing a fluctuating or alternating electromagnetic field.

In such embodiments, the aerosol-generating article engages with the aerosol-generating device such that, in use, the fluctuating or alternating electromagnetic field produced by the inductor induces eddy currents in the susceptor, causing the susceptor to heat up as a result of one or both of resistive losses (Joule heating) and, where the susceptor is magnetic, hysteresis losses. Heat generated in the susceptor is transferred to the periphery of the aerosol-forming substrate by conduction.

According to the invention there is also provided an aerosol-generating system comprising: an aerosol-generating article according to the invention wherein the heat-conducting element is a susceptor; and an electrically-operated aerosol-generating device comprising an inductor for producing a fluctuating or alternating electromagnetic field.

In other embodiments, the aerosol-generating article may comprise a heat source. In such embodiments, the heat-conducting element transfers heat from the heat source to the periphery of the aerosol-forming substrate by conduction.

In preferred embodiments, the aerosol-generating article comprises a combustible heat source upstream of the aerosol-forming substrate.

In particularly preferred embodiments, the aerosol-generating article comprises a combustible carbonaceous heat source upstream of the aerosol-forming substrate.

As used herein, the term 'carbonaceous' is used to describe a combustible heat source comprising carbon.

Preferably, the combustible heat source is a solid combustible heat source.

Advantageously, the heat-conducting element is around and in contact with at least a rear portion of the combustible heat source and at least a front portion of the wrapper.

Advantageously, the heat-conducting element is around and in direct contact with at least a rear portion of the combustible heat source and at least a front portion of the wrapper.

In such embodiments, the heat-conducting element provides a thermal link between the combustible heat source and the aerosol-forming substrate of the aerosol-generating article. This advantageously helps to facilitate adequate heat transfer from the combustible heat source to the aerosol-forming substrate to provide an acceptable aerosol.

The combustible heat source is located at or proximate to the distal end of the aerosol-generating article.

Preferably, the combustible heat source is substantially cylindrical.

The combustible heat source may have a length of between about 7 mm and about 17 mm, for example a length of between about 7 mm and about 15 mm or a length of between about 7 mm and about 13 mm.

The combustible heat source may have a diameter of between about 5 mm and about 9 mm, for example a diameter of between about 7 mm and about 8 mm.

The aerosol-generating article may comprise a cap configured to at least partially cover a front portion of the combustible heat source. In such embodiments, the cap is removable to expose a front portion of the combustible heat source prior to use of the aerosol-generating article.

As used herein, the term 'cap' is used to describe a protective cover at the distal end of the aerosol-generating article that substantially surrounds a front portion of the combustible heat source.

The aerosol-generating article may comprise a non-combustible substantially air impermeable barrier between a rear end face of the combustible heat source and the aerosol-forming substrate.

Inclusion of a non-combustible substantially air impermeable barrier between the rear end face of the combustible heat source and the aerosol-forming substrate may advantageously limit the temperature to which the aerosol-forming substrate is exposed during ignition and combustion of the combustible heat source. This may help to avoid or reduce thermal degradation or combustion of the aerosol-forming substrate during use of the aerosol-generating article.

Inclusion of a non-combustible substantially air impermeable barrier between the rear end face of the combustible heat source and the aerosol-forming substrate may advantageously substantially prevent or inhibit migration of components of the aerosol-forming substrate to the combustible heat source during storage and use of the aerosol-generating article.

As used herein, the term 'non-combustible' is used to describe a barrier that is substantially non-combustible at temperatures reached by the combustible heat source during ignition and combustion thereof.

The front end face of the combustible heat source is at the upstream end of the combustible heat source. The upstream end of the combustible heat source is the end of the combustible heat source furthest from the proximal end of the aerosol-generating article. A rear end face of the combustible heat source is opposed to the front end face of the combustible heat source. The rear end face of the combustible heat source is at the downstream end of the combustible heat source. The downstream end of the combustible heat source is the end of the combustible heat source closest to the proximal end of the aerosol-generating article.

The barrier may abut one or both of the rear end face of the combustible heat source and the aerosol-forming substrate. Alternatively, the barrier may be spaced apart from one or both of the rear end face of the combustible heat source and the aerosol-forming substrate.

Advantageously, the barrier is adhered or otherwise affixed to the rear end face of the combustible heat source.

Suitable methods for adhering or affixing a barrier to the rear end face of the combustible heat source are known in the art and include, but are not limited to: spray-coating; vapour deposition; dipping; material transfer (for example, brushing or gluing); electrostatic deposition; pressing; or any combination thereof.

The barrier between the rear end face of the combustible heat source and the aerosol-forming substrate may have a low thermal conductivity or a high thermal conductivity. For example, the barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the barrier between the rear end face of the combustible heat source and the aerosol-forming substrate may be appropriately adjusted to achieve good performance. For example, the barrier may have a thickness of between about 10 microns and about 500 microns.

The barrier between the rear end face of the combustible heat source and the aerosol-forming substrate may be formed from one or more suitable materials that are substantially thermally stable and non-combustible at temperatures achieved by the combustible heat source during ignition and combustion thereof. Suitable materials are known in the art and include, but are not limited to: clays such as, for example, bentonite and kaolinite; glasses; minerals; ceramic materials; resins; metals; or any combination thereof.

In certain preferred embodiments, the barrier comprises aluminium foil.

A barrier of aluminium foil may be applied to the rear end face of the combustible heat source by gluing or pressing it to the combustible heat source. The barrier may be cut or otherwise machined so that the aluminium foil covers and adheres to at least substantially the entire rear end face of the combustible heat source. Advantageously, the aluminium foil covers and adheres to the entire rear end face of the combustible heat source.

Aerosol-generating articles according to the invention may comprise a non-blind combustible heat source upstream of the aerosol-forming substrate.

As used herein, the term 'non-blind' is used to describe a combustible heat source including at least one airflow channel extending from the front end face to the rear end face of the combustible heat source.

As used herein, the term 'airflow channel' is used to describe a channel extending along the length of a combustible heat source through which air may be drawn for inhalation by a user.

Aerosol-generating articles according to the invention may comprise a non-blind combustible carbonaceous heat source upstream of the aerosol-forming substrate.

In aerosol-generating articles according to the invention comprising a non-blind combustible heat source upstream of the aerosol-forming substrate, the at least one airflow channel extending from the front end face to the rear end face of the non-blind combustible heat source forms part of one or more airflow pathways along which air may be drawn through the aerosol-generating article for inhalation by a user.

In aerosol-generating articles according to the invention comprising a non-blind combustible heat source upstream of the aerosol-forming substrate, heating of the aerosol-forming substrate occurs by conduction and forced convection.

Where aerosol-generating articles according to the invention comprise a non-blind combustible heat source upstream of the aerosol-forming substrate and a non-combustible, substantially air impermeable barrier between the rear end face of the combustible heat source and the aerosol-forming substrate, the barrier should allow air entering the aerosol-generating article through the at least one airflow channel extending from the front end face to the rear end face of the combustible heat source to be drawn downstream through the aerosol-generating article.

The aerosol-generating article may comprise a non-combustible substantially air impermeable barrier between the non-blind combustible heat source and the at least one airflow channel.

Inclusion of a non-combustible substantially air impermeable barrier between the non-blind combustible heat source and the at least one airflow channel may advantageously substantially prevent or inhibit combustion and decomposition products formed during ignition and combustion of the non-blind combustible heat source from entering air drawn into the aerosol-generating article through the at least one airflow channel as the drawn air passes through the at least one airflow channel.

Inclusion of a non-combustible substantially air impermeable barrier between the non-blind combustible heat source and the at least one airflow channel may advantageously substantially prevent or inhibit activation of combustion of the non-blind combustible heat source during puffing by a user. This may substantially prevent or inhibit spikes in the temperature of the aerosol-forming substrate during puffing by a user.

The barrier between the non-blind combustible heat source and the at least one airflow channel may have a low thermal conductivity or a high thermal conductivity.

The thickness of the barrier between the non-blind combustible heat source and the at least one airflow channel may be appropriately adjusted to achieve good performance.

The barrier between the non-blind combustible heat source and the at least one airflow channel may be formed from one or more suitable materials that are substantially thermally stable and non-combustible at temperatures achieved by the non-blind combustible heat source during ignition and combustion thereof. Suitable materials are known in the art and include, but are not limited to: clays; metal oxides, such as iron oxide, alumina, titania, silica, silica-alumina, zirconia and ceria; zeolites; zirconium phosphate and other ceramic materials; or any combination thereof.

The barrier between the non-blind combustible heat source and the at least one airflow channel may comprise a liner inserted into the at least one airflow channel.

The barrier between the non-blind combustible heat source and the at least one airflow channel may be adhered or otherwise affixed to the inner surface of the at least one airflow channel of the non-blind combustible heat source.

Suitable methods for adhering or affixing a barrier to the inner surface of the at least one airflow channel of the non-blind combustible heat source are known in the art and include, but are not limited to, the methods described in U.S. Pat. No. 5,040,551 and WO-A2-2009/074870.

In preferred embodiments, aerosol-generating articles according to the invention comprise a blind combustible heat source upstream of the aerosol-forming substrate.

In particularly preferred embodiments, aerosol-generating articles according to the invention comprise a blind combustible carbonaceous heat source upstream of the aerosol-forming substrate.

As used herein, the term 'blind' is used to describe a combustible heat source that does not include any airflow channels extending from the front end face to the rear end face of the combustible heat source. As used herein, the term 'blind' is also used to describe a combustible heat source including one or more airflow channels extending from the front end face of the combustible heat source to the rear end face of the combustible heat source, wherein a non-combustible substantially air impermeable barrier between the rear end face of the combustible heat source and the aerosol-forming substrate barrier prevents air from being drawn along the length of the combustible heat source through the one or more airflow channels.

In aerosol-generating articles according to the invention comprising a blind combustible heat source upstream of the aerosol-forming substrate, heat transfer from the blind combustible heat source to the aerosol-forming substrate occurs primarily by conduction and heating of the aerosol-forming substrate by forced convection is minimised or reduced. This may advantageously help to minimise or reduce the impact of a user's puffing regime on the composition of the mainstream aerosol of the aerosol-generating article.

In use, air drawn along one or more airflow pathways through aerosol-generating articles according to the invention comprising a blind combustible heat source upstream of the aerosol-forming substrate for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

Inclusion of a blind combustible heat source upstream of the aerosol-forming substrate may also advantageously substantially prevent or inhibit combustion and decomposition products and other materials formed during ignition and combustion of the blind combustible heat source from entering air drawn through the aerosol-generating article during use thereof.

Aerosol generating articles according to the invention comprising a blind combustible heat source upstream of the aerosol-forming substrate comprise one or more air inlets downstream of the rear end face of the blind combustible heat source for drawing air into one or more airflow pathways through the aerosol generating article.

Aerosol generating articles according to the invention comprising a non-blind combustible heat source upstream of the aerosol-forming substrate may also comprise one or more air inlets downstream of the rear end face of the non-blind combustible heat source for drawing air into one or more airflow pathways through the aerosol generating article.

In certain embodiments, aerosol generating articles according to the invention comprising a blind combustible heat source upstream of the aerosol-forming substrate comprise one or more air inlets around the periphery of the aerosol-forming substrate.

In such embodiments, during puffing by a user cool air is drawn into the aerosol-forming substrate of the aerosol-generating article through the one or more air inlets around the periphery of the aerosol-forming substrate. This advantageously reduces the temperature of the aerosol-forming substrate and so substantially prevents or inhibits spikes in the temperature of the aerosol-forming substrate during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more air inlets around the periphery of the aerosol-forming substrate, advantageously helps to avoid or reduce combustion or pyrolysis of the aerosol-forming substrate under intense puffing regimes. In addition, inclusion of one or more air inlets around the periphery of the aerosol-forming substrate advantageously helps to minimise or reduce the impact of a user's puffing regime on the composition of the mainstream aerosol of the aerosol-generating article.

In certain preferred embodiments, aerosol-generating articles according to the invention comprising a blind combustible heat source upstream of the aerosol-forming substrate comprise one or more air inlets located proximate to the downstream end of the aerosol-forming substrate.

It will be appreciated that aerosol-generating articles according to the invention may comprise a non-blind combustible heat source upstream of the aerosol-forming substrate or a blind combustible heat source upstream of the aerosol-forming substrate that comprises one or more closed or blocked passageways through which air may not be drawn for inhalation by a user.

For example, aerosol-generating articles according to the invention may comprise a combustible heat source upstream of the aerosol-forming substrate comprising one or more closed passageways that extend from the front end face of the combustible heat source only part way along the length combustible heat source.

The inclusion of one or more closed air passageways increases the surface area of the combustible heat source that is exposed to oxygen from the air and may advantageously facilitate ignition and sustained combustion of the combustible heat source.

Where aerosol-generating articles according to the invention comprise a combustible carbonaceous heat source upstream of the aerosol-forming substrate, the combustible carbonaceous heat source preferably has a carbon content of at least about 35 percent by dry weight of the combustible carbonaceous heat source, for example a carbon content of at least about 40 percent by dry weight of the combustible carbonaceous heat source or a carbon content of at least about 45 percent by dry weight of the combustible carbonaceous heat source.

In some embodiments, the combustible carbonaceous heat source may be a combustible carbon-based heat source.

As used herein, the term 'carbon-based' is used to describe a combustible carbonaceous heat source comprised primarily of carbon, that is a combustible carbonaceous heat source having a carbon content of at least about 50 percent by dry weight of the combustible carbonaceous heat source. For example, the combustible carbonaceous heat source may have a carbon content of at least about 60 percent by dry weight of the combustible carbonaceous heat source or at least about 70 percent by dry weight of the combustible carbonaceous heat source or at least about 80 percent by dry weight of the combustible carbonaceous heat source.

The combustible carbonaceous heat source may be formed from one or more suitable carbon-containing materials.

One or more binders may be combined with the one or more carbon-containing materials. In such embodiments, the combustible carbonaceous heat source may comprise one or more organic binders, one or more inorganic binders or a combination of one or more organic binders and one or more inorganic binders.

The combustible carbonaceous heat source may comprise one or more additives in order to improve the properties of the combustible carbonaceous heat source. Suitable additives include, but are not limited to: additives to promote consolidation of the combustible carbonaceous heat source (for example, sintering aids); additives to promote ignition of the combustible carbonaceous heat source (for example, oxidisers such as perchlorates, chlorates, nitrates, peroxides, permanganates, zirconium and combinations thereof); additives to promote combustion of the combustible carbonaceous heat source (for example, potassium and potassium salts, such as potassium citrate); additives to promote decomposition of one or more gases produced by combustion of the combustible carbonaceous heat source (for example catalysts, such as CuO, $Fe_2O_3$ and $Al_2O_3$); or any combination thereof.

Advantageously, the combustible carbonaceous heat source comprises at least one ignition aid. In certain preferred embodiments, the combustible carbonaceous heat source comprises at least one ignition aid as described in WO-A1-2012/164077.

Suitable processes for producing combustible carbonaceous heat sources for use in aerosol-generating articles according to the invention are known in the art and include, but are not limited to, pressing processes and an extrusion processes.

Aerosol-generating articles according to the invention may comprise one or more additional heat-conducting elements around at least a portion of the heat-conducting element.

Aerosol-generating articles according to the invention may comprise a transfer element or spacer element downstream of the aerosol-forming substrate.

The transfer element may abut the aerosol-forming substrate. Alternatively, the transfer element may be spaced apart from the aerosol-forming substrate.

The inclusion of a transfer element advantageously allows cooling of the aerosol generated by heat transfer to the aerosol-forming substrate. The inclusion of a transfer element also advantageously allows the overall length of aerosol-generating articles according to the invention to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or a length of between about 15 mm and about 30 mm. The transfer element may have other lengths depending upon the desired overall length of the aerosol-generating article, and the presence and length of other components within the aerosol-generating article.

The transfer element may comprise at least one open-ended tubular hollow body. In such embodiments, in use, air drawn into the aerosol-generating article passes through the at least one open-ended tubular hollow body as it passes downstream through the aerosol-generating article from the aerosol-forming substrate to the mouthpiece.

The transfer element may comprise at least one open-ended tubular hollow body formed from one or more suitable materials that are substantially thermally stable at the temperature of the aerosol generated by the transfer of heat to the aerosol-forming substrate. Suitable materials are known in the art and include, but are not limited to, paper, cardboard, plastics, such a cellulose acetate, ceramics and combinations thereof.

Aerosol generating articles according to the invention may comprise an aerosol-cooling element or heat exchanger downstream of the aerosol-forming substrate. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Where aerosol generating articles according to the invention comprise a transfer element downstream of the aerosol-forming substrate and an aerosol-cooling element downstream of the aerosol-forming substrate, the aerosol-cooling element is preferably downstream of the transfer element.

Aerosol-generating articles according to the invention may comprise a mouthpiece downstream of the aerosol-forming substrate.

Preferably, the mouthpiece is located at the proximal end of the aerosol generating article.

The mouthpiece is preferably of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Aerosol-generating articles according to the invention may comprise one or more aerosol modifying agents downstream of the aerosol-forming substrate. For example, one or more of the mouthpiece, transfer element and aerosol-cooling element of aerosol-generating articles according to the invention may comprise one or more aerosol modifying agents.

As used herein, the term 'aerosol-modifying agent' is used to describe any agent that, in use, modifies one or more features or properties of an aerosol generated by the aerosol-forming substrate of the aerosol-generating article.

Suitable aerosol-modifying agents include, but are not limited to: flavourants; and chemesthetic agents.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Aerosol-generating articles according to the invention may comprise one or more aerosol modifying agents that are both a flavourant and a chemesthetic agent downstream of the aerosol-forming substrate. For example, one or more of the mouthpiece, transfer element and aerosol-cooling element of aerosol-generating articles according to the invention may comprise menthol or another flavourant that provides a cooling chemesthetic effect.

Aerosol-generating articles according to the invention may comprise an outer wrapper that circumscribes the aerosol-forming substrate and the heat-conducting element.

Where aerosol-generating articles according to the invention comprise one or more components downstream of the aerosol-forming substrate such as, for example, a transfer element, a cooling element or a mouthpiece, the outer wrapper may circumscribe some or all of the components downstream of the aerosol-forming substrate.

Where aerosol-generating articles according to the invention comprise a combustible heat source upstream of the aerosol-forming substrate and an outer wrapper, the outer wrapper preferably circumscribes at least a rear portion of the combustible heat source.

Aerosol-generating articles according to the invention may comprise outer wrappers formed from any suitable material or combination of materials. Suitable materials are known in the art and include, but are not limited to, cigarette paper.

Aerosol-generating articles according to the invention may be assembled using known methods and machinery.

For the avoidance of doubt, features described above in relation to one aspect of the invention may also be applicable to other aspects of the invention.

Figure 2:
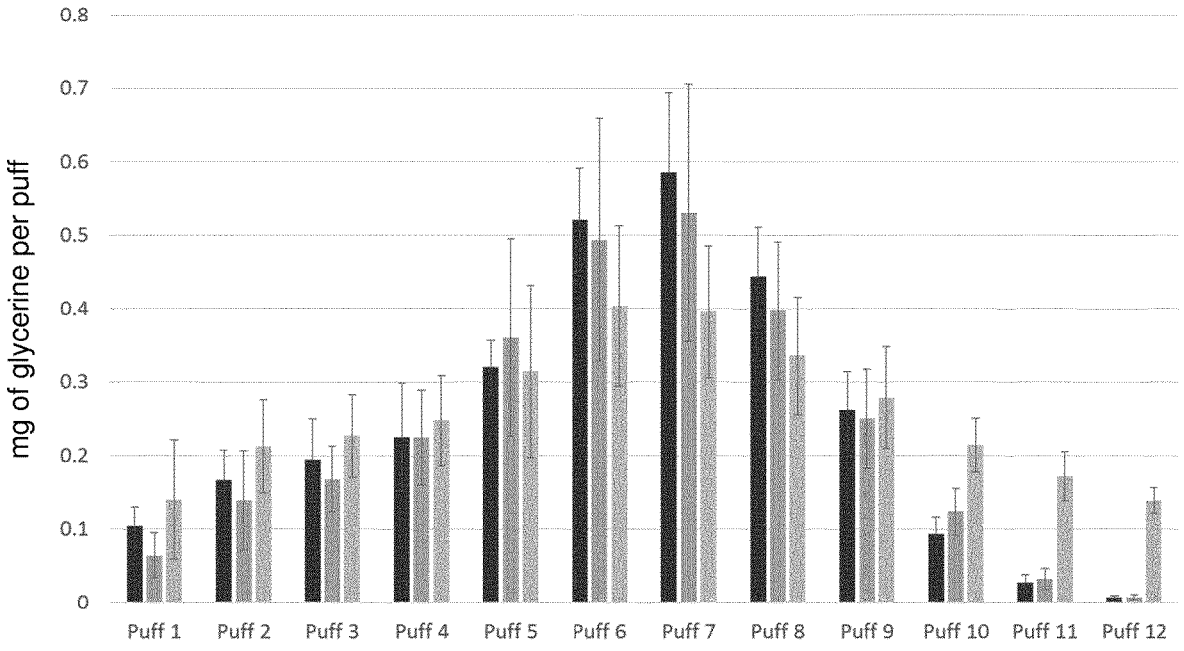
Figure 2:
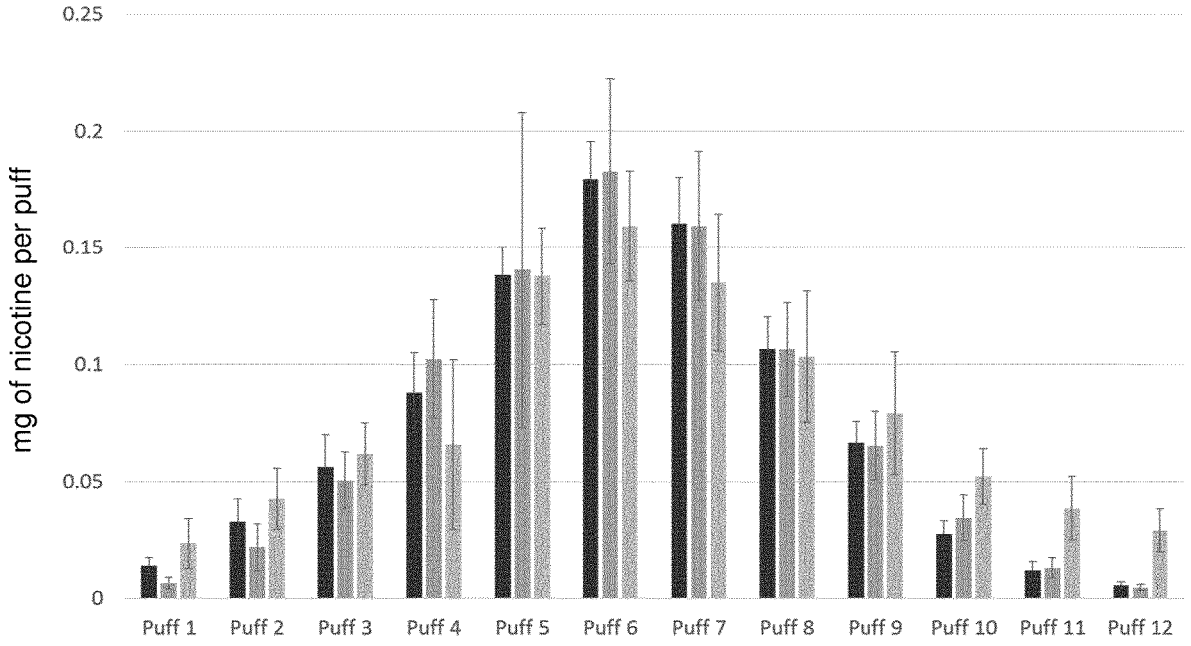

The invention will be further described, by way of example only, with reference to the accompanying drawings in which:

FIG. 1 shows a schematic longitudinal cross-section of an aerosol-generating article according to an embodiment of the invention; and FIG. 2 shows a graph of (a) the amounts of aerosol former (glycerine) and (b) the amounts of nicotine delivered per puff for an aerosol-generating article according to the embodiment of the invention shown in FIG. 1 and two aerosol-generating articles not according to the invention.

The aerosol-generating article 2 according to the embodiment of the invention shown in FIG. 1 comprises a combustible carbonaceous heat source 4 having a front end face 6 and an opposed rear end face 8, an aerosol-forming substrate 10, a transfer element 12, an aerosol-cooling element 14, a spacer element 16 and a mouthpiece 18 in abutting coaxial alignment. As shown in FIG. 1, the aerosol-forming substrate 10, transfer element 12, aerosol-cooling element 14, spacer element 16 and mouthpiece 18 and a rear portion of the blind combustible heat source 4 are wrapped in an outer wrapper 20 of sheet material such as, for example, cigarette paper.

The combustible carbonaceous heat source 4 is a blind carbonaceous combustible heat source and is located at the distal end of the aerosol-generating article 2. As shown in FIG. 1, a non-combustible substantially air impermeable barrier 22 in the form of a disc of aluminium foil is provided between the rear end face 8 of the combustible carbonaceous heat source 4 and the aerosol-forming substrate 10. The barrier 22 is applied to the rear end face 8 of the combustible carbonaceous heat source 4 by pressing the disc of aluminium foil onto the rear end face 8 of the combustible carbonaceous heat source 4 and abuts the rear end face 8 of the combustible carbonaceous heat source 4 and the aerosol-forming substrate 10.

The aerosol-forming substrate 10 is located immediately downstream of the barrier 22 applied to the rear end face 8 of the combustible carbonaceous heat source 4. The aerosol-forming substrate 10 comprises a gathered crimped sheet of homogenised tobacco material 24 and a wrapper 26 around and in direct contact with the gathered crimped sheet of homogenised tobacco material 24. The gathered crimped sheet of homogenised tobacco material 24 comprises a suitable aerosol former such as, for example, glycerine. The wrapper 26 comprises a suitable aerosol former such as, for example, glycerine, and has an aerosol former content of between about 8% and about 20% by weight of the total weight of the wrapper.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube.

The mouthpiece 18 is located immediately downstream of the spacer element 16. As shown in FIG. 1, the mouthpiece 18 is located at the proximal end of the aerosol-generating article 2 and comprises a cylindrical plug of suitable filtration material 30 such as, for example, cellulose acetate tow of very low filtration efficiency, wrapped in filter plug wrap 32.

The aerosol-generating article may further comprise a band of tipping paper (not shown) circumscribing a downstream end portion of the outer wrapper 20.

As shown in FIG. 1, the aerosol-generating article 2 further comprises a heat-conducting element 34 formed from a suitable thermally conductive material such as, for example, aluminium foil around and in direct contact with a rear portion 4*b* of the blind combustible heat source 4 and a front portion 10*a* of the aerosol-forming substrate 10. In the aerosol-generating article 2 according to the first embodiment of the invention shown in FIG. 1, the aerosol-forming substrate 10 extends downstream beyond the heat-conducting element 34. That is, the heat-conducting element 34 is not around and in direct contact with a rear portion of the aerosol-forming substrate 10. However, it will be appreciated that in other embodiments of the invention (not shown), the heat-conducting element 34 may be around and in contact with the entire length of the aerosol-forming substrate 10. It will also be appreciated that in other embodiments of the invention (not shown), one or more additional heat-conducting elements may be provided that overlie the heat-conducting element 34.

The aerosol-generating article 2 according to the embodiment of the invention shown in FIG. 1 comprises one or more first air inlets 36 around the periphery of the aerosol-forming substrate 10. As shown in FIG. 1, a circumferential arrangement of first air inlets 36 is provided in the wrapper 26 of the aerosol-forming substrate 10 and the overlying outer wrapper 20 to admit cool air (shown by dotted arrows in FIG. 1) into the aerosol-forming substrate 10.

In use, a user ignites the combustible carbonaceous heat source 4. Once the combustible carbonaceous heat source 4 is ignited the user draws on the mouthpiece 18 of the aerosol-generating article 2. When a user draws on the mouthpiece 18, cool air (shown by dotted arrows in FIG. 1) is drawn into the aerosol-forming substrate 10 of the aerosol-generating article 2 through the first air inlets 36.

The periphery of the front portion 10*a* of the aerosol-forming substrate 10 is heated by conduction through the rear end face 8 of the combustible carbonaceous heat source 4 and the barrier 22 and through the heat-conducting element 34.

The heating of the aerosol-forming substrate 10 by conduction releases aerosol former from the wrapper 26 and releases aerosol former and other volatile and semi-volatile compounds from the gathered crimped sheet of homogenised tobacco material 24. The compounds released from the aerosol-forming substrate 10 form an aerosol that is entrained in the air drawn into the aerosol-forming substrate 10 of the aerosol-generating article 2 through the first air inlets 36 as it flows through the aerosol-forming substrate 10. The drawn air and entrained aerosol (shown by dashed arrows in FIG. 1) pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the aerosol-generating article 2. The non-combustible substantially air impermeable barrier 22 on the rear end face 8 of the combustible carbonaceous heat source 4 isolates the combustible carbonaceous heat source 4 from air drawn through the aerosol-generating article 2 such that, in use, air drawn through the aerosol-generating article 2 does not come into direct contact with the combustible carbonaceous heat source 4.

An aerosol-generating article according to the embodiment of the invention shown in FIG. 1 is produced comprising: an aerosol-forming substrate comprising a gathered crimped sheet of homogenised tobacco material comprising glycerine and a tobacco-containing paper wrapper around and in direct contact with the gathered crimped sheet of homogenised tobacco material, the tobacco-containing paper wrapper having a glycerine content of 10% by weight of the total weight of the tobacco-containing paper wrapper; and a heat-conducting element formed of aluminium foil around and in contact with a front portion of the tobacco-containing paper wrapper.

A first comparative aerosol-generating article not according to the invention is produced comprising: an aerosol-forming substrate comprising a gathered crimped sheet of homogenised tobacco material comprising glycerine and a tobacco-containing paper wrapper around and in direct contact with the gathered crimped sheet of homogenised tobacco material; and a heat-conducting element formed of aluminium foil around and in contact with a front portion of the tobacco-containing paper wrapper. The tobacco-containing paper wrapper in the first comparative aerosol-generating article not according to the invention does not comprise glycerine. Otherwise, the tobacco-containing paper wrapper in the first comparative aerosol-generating article not according to the invention is the same as the tobacco-containing paper wrapper in the aerosol-generating article according to the invention.

A second aerosol-generating article not according to the invention is also produced comprising: an aerosol-forming substrate comprising a gathered crimped sheet of homogenised tobacco material comprising glycerine and a paper wrapper of filter plug wrap around and in direct contact with the gathered crimped sheet of homogenised tobacco material; and a heat-conducting element formed of aluminium foil around and in contact with a front portion of the paper wrapper of filter plug wrap.

The first comparative aerosol-generating article and the second comparative aerosol-generating article not according to the invention differ only from the aerosol-generating article according to the invention in the type of wrapper around and in direct contact with the gathered crimped sheet of homogenised tobacco material; the combustible carbonaceous heat sources, heat-conducting elements, transfer elements, aerosol-cooling elements, spacer elements and mouthpieces and all other components and dimensions of the first comparative aerosol-generating article and the second comparative aerosol-generating article are identical to those of the aerosol-generating article according to the invention.

The amounts of (a) glycerine (in micrograms) and (b) nicotine (in micrograms) per puff for the aerosol-generating article according to the invention, the first comparative aerosol-generating article and the second comparative aerosol-generating article are measured as a function of puff number under a Health Canada smoking regime over 12 puffs with a puff volume of 55 ml, puff duration of 2 seconds and a puff interval of 30 seconds. Each puff is collected on a Cambridge filter pad and then extracted with a liquid solvent. The resulting liquid is analysed by gas chromatography to determine the nicotine delivery. The results are shown in: FIG. 2 (*a*) puff-by-puff glycerine delivery profile; and FIG. 2 (*b*) puff-by-puff nicotine delivery profile. In FIG. 2 (*a*) and FIG. 2 (*b*) the puff-by-puff delivery profile for the aerosol-generating article according to the invention is shown by the right hand columns, the puff-by-puff delivery profile for the first comparative aerosol-generating article is shown by the central columns and the puff-by-puff delivery profile for the second comparative aerosol-generating article is shown by the left-hand columns.

As illustrated FIG. 2 (*a*) and 2 (*b*), the inclusion of a wrapper having an aerosol former content of 10% by weight of the total weight of the wrapper around and in direct contact with the tobacco material of the aerosol-forming substrate of the aerosol-generating article according to the invention advantageously results in more consistent puff-by-puff glycerine and nicotine delivery profiles than are obtained for the first comparative aerosol-generating article not according to the invention and the second comparative aerosol-generating article not according to the invention, which comprise an aerosol-forming substrate comprising tobacco material and a wrapper around and in direct contact with the tobacco material wherein the wrapper does not have an aerosol former content of between about 5% and about 30% by weight of the total weight of the wrapper. As shown in FIG. 2 (*a*) and 2 (*b*), the inclusion of a wrapper having an aerosol former content of 10% by weight of the total weight of the wrapper around and in direct contact with the tobacco material of the aerosol-forming substrate of the aerosol-generating article according to the invention generally results in an increase in the amounts of nicotine and glycerine in initial puffs (puffs 1 to 3) and final puffs (puffs 9 to 12) and a decrease in the amounts of nicotine and glycerine in intermediate puffs (puffs 5 to 7) compared to the first comparative aerosol-generating article and the second comparative aerosol-generating article.

The specific embodiments and examples described above illustrate but do not limit the invention. It is to be understood that other embodiments of the invention may be made and the specific embodiments and examples described herein are not exhaustive.

The invention claimed is:

1. An aerosol-generating article, comprising:

an aerosol-forming substrate comprising aerosol-forming material and a tobacco-containing wrapper around and in contact with the aerosol-forming material, the wrapper having an aerosol former content of between about 5% and about 30% by weight of the total weight of the wrapper;

a combustible heat source upstream of the aerosol-forming substrate; and a heat-conducting element around and in contact with at least a portion of the wrapper.

2. The aerosol-generating article according to claim 1, wherein the heat-conducting element is around and in contact with at least a rear portion of the combustible heat source and at least a front portion of the wrapper.

3. The aerosol-generating article according to claim 1, further comprising a non-combustible substantially air-impermeable barrier between a rear end face of the combustible heat source and the aerosol-forming substrate.

4. The aerosol-generating article according to claim 1, wherein the combustible heat source is a blind combustible carbonaceous heat source.

5. The aerosol-generating article according to claim 1, wherein the wrapper has an aerosol former content of at least about 10% by weight of a total weight of the wrapper.

6. The aerosol-generating article according to claim 1, wherein the wrapper has an aerosol former content of less than or equal to about 20% by weight of a total weight of the wrapper.

7. The aerosol-generating article according to claim 1, wherein the aerosol former comprises one or more polyhydric alcohols.

8. The aerosol-generating article according to claim 7, wherein the aerosol former comprises glycerine.

9. The aerosol-generating article according to claim 1, wherein the heat-conducting element comprises one or both of a metal foil and a metal alloy foil.

10. The aerosol-generating article according to claim 9, wherein the heat-conducting element comprises aluminum foil.

11. The aerosol-generating article according to claim 1, wherein the aerosol-forming substrate comprises tobacco material.

12. An aerosol-generating article, comprising:

an aerosol-forming substrate comprising aerosol-forming material and a wrapper around and in contact with the aerosol-forming material, the wrapper having an aerosol former content of between about 5% and about 30% by weight of the total weight of the wrapper; and a heat-conducting element around and in contact with at least a portion of the wrapper, wherein the heat-conducting element is a susceptor.

13. The aerosol-generating article according to claim 12, wherein the wrapper is a tobacco-containing wrapper.

14. An aerosol-generating system, comprising:

an aerosol-generating article according to claim 12; and an electrically-operated aerosol-generating device comprising an inductor configured to produce a fluctuating or alternating electromagnetic field.

* * * * *